US007673875B2

(12) United States Patent
Motohashi et al.

(10) Patent No.: US 7,673,875 B2
(45) Date of Patent: Mar. 9, 2010

(54) SHEET CARRYING UNIT, IMAGE FORMING APPARATUS AND SHEET CARRYING CONTROL METHOD FOR DOUBLE FEED DETECTING OF ACCEPTED SHEETS

(75) Inventors: Muneyuki Motohashi, Nara (JP); Tsuyoshi Iwamoto, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 467 days.

(21) Appl. No.: 11/609,362

(22) Filed: Dec. 12, 2006

(65) Prior Publication Data

US 2007/0138738 A1 Jun. 21, 2007

(30) Foreign Application Priority Data

Dec. 19, 2005 (JP) ..... 2005-365181

(51) Int. Cl.
*B65H 7/12* (2006.01)

(52) U.S. Cl. ..... 271/263; 271/258.01; 271/262

(58) Field of Classification Search ..... 271/258.01, 271/262, 265.04, 263
See application file for complete search history.

(56) References Cited

U.S. PATENT DOCUMENTS 5,435,540 A * 7/1995 Martin et al. ..... 271/122
2007/0090591 A1* 4/2007 Roberts ..... 271/258.01

FOREIGN PATENT DOCUMENTS

JP 2004-004181 1/2004
JP 2004-352390 12/2004

* cited by examiner

*Primary Examiner*—Patrick H Mackey
*Assistant Examiner*—Gerald W McClain
(74) *Attorney, Agent, or Firm*—Renner, Otto, Boisselle & Sklar, LLP

(57) ABSTRACT

Based on the type of sheet and the detection result of double feed, carrying a sheet is stopped. Carrying of a predetermined type of sheet is not stopped even when double feed is detected. The predetermined type of sheet is a sheet having air space inside thereof (an envelope, an OHP sheet, Kent paper, or the like).

15 Claims, 5 Drawing Sheets

SHEET CARRYING UNIT, IMAGE FORMING APPARATUS AND SHEET CARRYING CONTROL METHOD FOR DOUBLE FEED DETECTING OF ACCEPTED SHEETS

CROSS-REFERENCE TO RELATED APPLICATIONS

This Nonprovisional application claims priority under 35 U.S.C. §119(a) on Patent Application No. 2005-365181 filed in Japan on Dec. 19, 2005, the entire contents of which are hereby incorporated by reference.

BACKGROUND OF THE INVENTION

1. Field of the Invention

The present invention relates to: a sheet carrying unit which stops carrying of a sheet based on detection result of double feed of sheets; an image forming apparatus which comprises the sheet carrying unit; and a sheet carrying control method of stopping carrying of a sheet based on detection result of double feed of sheets.

2. Description of Related Art

In an image forming apparatus for forming an image on recording paper, such as a printer or a complex machine having a plurality of functions such as a scanning function, a printing function and a facsimile function, the recording paper may not be carried separately one by one due to the humidity, the static electricity or the like and double feed, which means carrying of two or more sheets of recording paper overlapped with each other, may possibly take place during carrying of recording paper from a paper cassette or a manual paper feeding tray.

Therefore, a double feed sensor for detecting double feed is provided to stop carrying of recording paper once and stop an image forming process including an exposure process, a development process, a transfer process, a fixing process and the like, and then eject the recording paper, when double feed is detected. Used as a double feed sensor is, for example, an ultrasonic sensor. Since the output level of an ultrasonic sensor changes depending on air space formed between one sheet of recording paper and another, it is possible to detect double feed of recording paper based on a change in the output level (see Japanese Patent Application Laid-Open No. 2004-4181). When an ultrasonic sensor is used wherein the recording paper is kept in a noncontact state, it is possible to detect double feed without disturbing carrying of recording paper and regardless of the thickness of the recording paper.

However, when recording paper having air space inside thereof, such as an envelope, is to be carried, there is a problem that double feed is detected even in carrying of only one sheet and the printing process is stopped, since double feed of recording paper is detected based on a change in the output level of the ultrasonic sensor depending on air space between a sheet of recording paper and another. Moreover, in addition to an envelope, double feed is also detected in carrying of only one sheet and the printing process is stopped when recording paper has air space inside thereof as in an OHP (OverHead Projector) sheet made by appending and attaching a protective sheet, Kent paper made by pasting two sheets together, or the like. Moreover, double feed is also detected in carrying of only one sheet and the printing process is stopped for recording paper such as WASHI (Japanese paper) having air space distributed therein. Therefore, a problem that an image forming process cannot be executed occurs.

BRIEF SUMMARY OF THE INVENTION

The present invention has been made with the aim of solving the above problems, and it is an object thereof to provide a sheet carrying unit, an image forming apparatus and a sheet carrying control method which are constructed to accept the type of a sheet to be carried and stop carrying of a sheet based on the accepted type of a sheet and detection result of double feed, so as to change a stopping process of a sheet attributable to double feed depending on the type of a sheet.

Another object of the present invention is to provide a sheet carrying unit and an image forming apparatus which are constructed to stop carrying of a sheet in response to detection of double feed when the accepted type of a sheet is not a predetermined type, so as not to stop carrying of a predetermined type of a sheet even when double feed is detected.

Another object of the present invention is to provide a sheet carrying unit, an image forming apparatus and a sheet carrying control method wherein the predetermined type of a sheet is a sheet having air space inside thereof, so that execution of a stopping process attributable to false detection of double feed is prevented and image formation becomes possible.

Another object of the present invention is to provide a sheet carrying unit and an image forming apparatus wherein the predetermined type of a sheet is any one of an envelope, an OHP sheet and Kent paper, so that execution of a stopping process attributable to false detection of double feed is prevented and image formation becomes possible.

Another object of the present invention is to provide a sheet carrying unit and an image forming apparatus which comprise a manual paper feeding tray and are constructed to carry a sheet placed in the manual paper feeding tray, so as to place the predetermined type of a sheet in the manual paper feeding tray and carry the sheet.

A sheet carrying unit according to the present invention is a sheet carrying unit comprising double feed detecting means for detecting double feed of sheets and stopping means for stopping carrying of a sheet based on detection result of the double feed detecting means, characterized by comprising accepting means for accepting a type of a sheet to be carried, wherein the stopping means is constructed to stop carrying of a sheet based on the type of a sheet accepted by the accepting means and detection result of the double feed detecting means.

A sheet carrying unit according to the present invention is characterized in that the stopping means is constructed to stop carrying of a sheet in response to detection of double feed by the double feed detecting means when the type of a sheet accepted by the accepting means is not a predetermined type.

A sheet carrying unit according to the present invention is characterized in that the predetermined type of a sheet is a sheet having air space inside thereof.

A sheet carrying unit according to the present invention is characterized in that the predetermined type of a sheet is any one of an envelope, an OHP sheet and Kent paper.

A sheet carrying unit according to the present invention is characterized by comprising a manual paper feeding tray and being constructed to carry a sheet placed in the manual paper feeding tray.

An image forming apparatus according to the present invention is characterized by comprising any one of sheet carrying unites according to the above invention and image forming means for forming an image on a sheet carried by the sheet carrying unit.

A sheet carrying control method according to the present invention is a sheet carrying control method of detecting double feed of sheets and stopping carrying of a sheet based on detection result of double feed, characterized in that a type of a sheet to be carried is accepted and carrying of a sheet is stopped based on the accepted type of a sheet and detection result of double feed.

A sheet carrying control method according to the present invention is characterized in that carrying of a sheet is stopped in response to detection of double feed when the accepted type of a sheet is not a sheet having air space inside thereof.

In the present invention wherein the stopping means stops carrying of a sheet based on the type of a sheet accepted by the accepting means and detection result of the double feed detecting means, a stopping process of a sheet attributable to double feed can be changed depending on a type of a sheet. For example, it is possible to stop carrying of a predetermined type of a sheet when double feed is detected or, in contrast, it is possible not to stop carrying of a predetermined type of a sheet even when double feed is detected.

In the present invention wherein the stopping means stops carrying of a sheet in response to detection of double feed by the double feed detecting means when the type of a sheet accepted by the accepting means is not a predetermined type, it is possible to inhibit a processing process attributable to detection of double feed for a predetermined type of a sheet and not to stop carrying even when double feed is detected. It should be noted that it is also possible to stop detection of double feed itself for a predetermined type of a sheet.

In the present invention wherein the predetermined type of a sheet is a sheet having air space inside thereof and a stopping process is not executed for the predetermined type of a sheet even though double feed is detected due to the air space, it becomes possible to prevent execution of a stopping process attributable to detection of double feed and carry a sheet to image forming means, for example, to execute image formation. Included in a sheet having air space inside thereof is an envelope, an OHP sheet, Kent paper, WASHI or the like.

In the present invention wherein the predetermined type of a sheet is any one of an envelope including two sheets overlapped with each other, an OHP sheet made by appending a protective sheet and Kent paper made by pasting two sheets together, all of which have air space in two sheets overlapped with each other, a stopping process is not executed for the predetermined type of a sheet even though double feed is detected. Accordingly, it becomes possible to prevent execution of a stopping process attributable to false detection of double feed and carry a sheet to image forming means, for example, to execute image formation.

In the present invention wherein a manual paper feeding tray is provided and a sheet placed in the manual paper feeding tray is carried, it is possible to place the predetermined type of a sheet in the manual paper feeding tray and carry the sheet. Especially, it is often the case that an envelope, an OHP sheet or Kent paper is placed in the manual paper feeding tray for the purpose of desirable carrying.

With the present invention, it is possible to change a stopping process of a sheet attributable to double feed depending on a type of a sheet.

With the present invention, carrying of a predetermined type of a sheet is not stopped even when double feed is detected.

With the present invention, it becomes possible to prevent execution of a stopping process attributable to false detection of double feed and achieve image formation.

With the present invention, it is possible to place the predetermined type of a sheet in a manual paper feeding tray and carry the sheet.

The above and further objects and features of the invention will more fully be apparent from the following detailed description with accompanying drawings.

DETAILED DESCRIPTION OF THE INVENTION

The following description will explain the present invention in detail with reference to the drawings illustrating an embodiment thereof.

Figure 1:
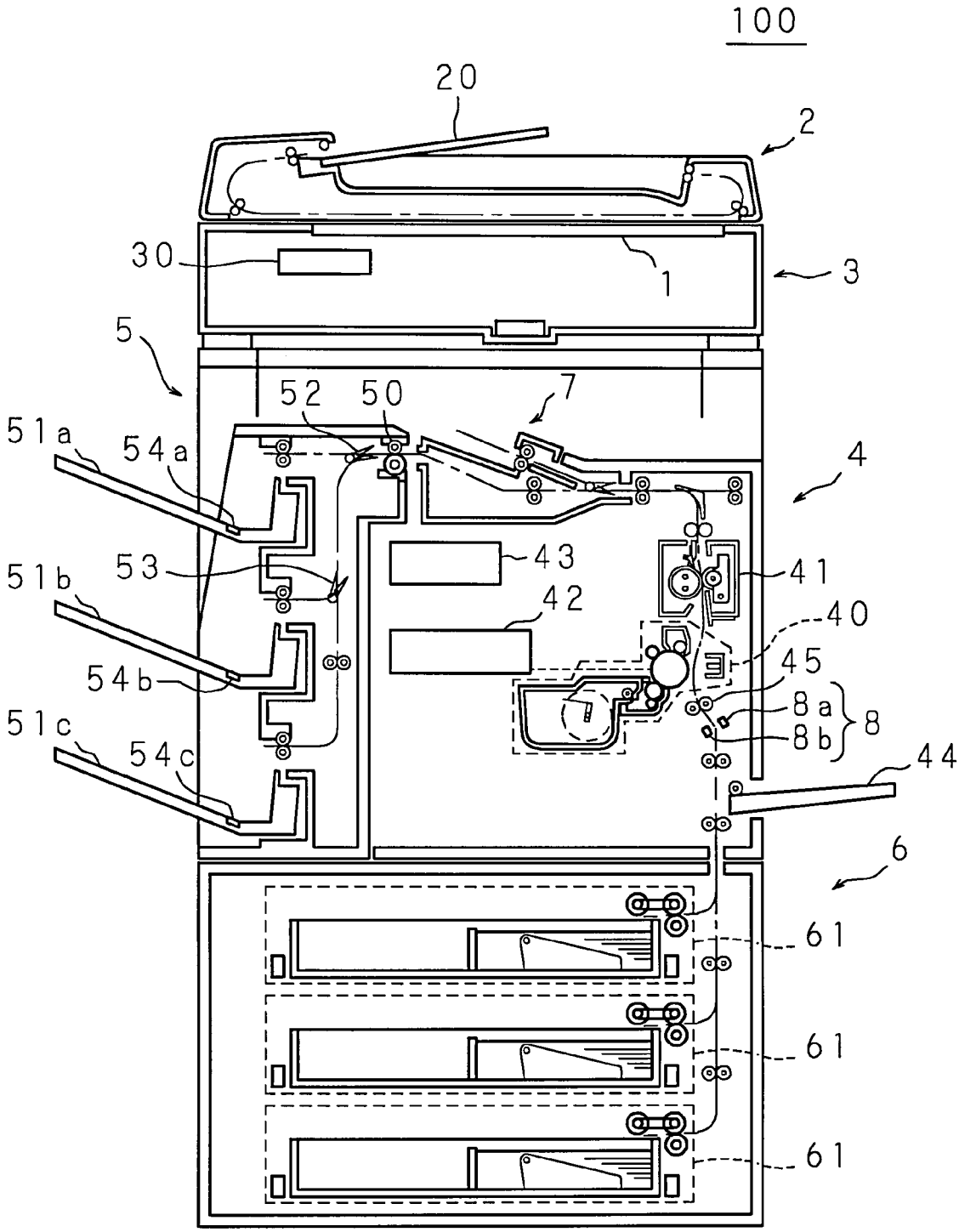
FIG. 1 is a schematic view showing the general structure of an image forming apparatus comprising a sheet carrying unit according to the present invention.

FIG. 1 is a schematic view showing the general structure of an image forming apparatus 100 comprising a sheet carrying unit according to the present invention. Denoted at 1 in the figure is a mounting table made of glass for mounting an original copy. Provided above the mounting table 1 is an automatic original copy carrying section 2 for carrying an original copy mounted on an original copy mounting tray 20. Provided below the mounting table 1 is a scanner section 3 which has an image reading section 30 for reading an image of an original copy on the mounting table 1.

The image reading section 30 has: a scanning section which reciprocates along and parallel to the lower surface of the mounting table 1; an imaging lens; a CCD (Charge Coupled Device) line sensor (all of which are not illustrated); and the like. The scanning section comprises: a light source for irradiating light to an original copy mounted on the mounting table 1 or an original copy carried along a paper path; a mirror for guiding light which has been reflected at the original copy to a predetermined optical path; and the like. The imaging lens provides an image at a predetermined position on the CCD line sensor with light guided from the scanning section. The CCD line sensor outputs an electric signal which is obtained by photoelectric conversion for a provided optical image. The image reading section 30 outputs data, which has been obtained by applying color separation to the respective color components of R (red), G (green) and B (blue) based on a color image read from the original copy, to a process control section 43 which will be explained later. The data outputted to the process control section 43 undergoes a predetermined image data process.

Provided below the scanner section 3 is an image forming section (image forming means) 4 for forming an image read by the image reading section 30 on recording paper (sheet). The image forming section 4 comprises: an electrographic processing section 40; a fixing apparatus 41; an optical writing section 42; a manual paper feeding tray 44 for holding recording paper; the process control section 43 for controlling the electrographic processing section 40, the fixing apparatus 41 and the optical writing section 42 mentioned above; and the like.

The electrographic processing section 40 comprises: a photoconductor drum to be driven to rotate; a developing apparatus for developing an electrostatic latent image formed on the surface of the photoconductor drum; a transfer apparatus for transferring a toner image on the surface of the photoconductor drum to recording paper; and the like. The fixing apparatus 41 has a fixing roller and applies hot processing to a toner image which has been transferred to and formed on recording paper, so as to fix the toner image on the recording paper.

The optical writing section 42 comprises: a semiconductor laser element for emitting dot light which is modulated corresponding to image data read by the image reading section 30 or image data inputted from an external personal computer or the like; a polygon mirror for deflecting laser emitted from the semiconductor laser element to a main scanning direction; a lens and a mirror (both are not illustrated) for providing an image on the surface of the photoconductor drum with laser deflected by the polygon mirror; and the like.

Provided below the image forming section 4 is a multistage paper feeding section 6 including recording paper holders 61, which are arranged in three stages in the vertical direction, for holding recording paper. The respective recording paper holders 61 hold recording paper of different sizes, so that recording paper of a required size is selected and the selected recording paper is carried to the electrographic processing section 40 for forming an output image.

Provided on the paper path upstream of the electrographic processing section 40 are resist rollers 45 for carrying recording paper in time with image formation. Provided on the paper path between the resist rollers 45 and the manual paper feeding tray 44 and multistage paper feeding section 6 is an ultrasonic sensor 8, which is counterposed across the paper path and has a transmitter 8*a* for transmitting ultrasonic wave and a receiver 8*b* for receiving ultrasonic wave transmitted from the transmitter 8*a*.

Provided on a side face of the image forming section 4 is a postprocessor 5 for performing post treatment (e.g., sorting, stapling or the like) for recording paper. The postprocessor 5 comprises: trays for ejection 51*a* (first tray), 51*b* (second tray) and 51*c* (third tray) for ejecting recording paper having an image formed thereon; guides 52 and 53 for switching ejection of recording paper to any one of trays; a carrying roller 50 for carrying recording paper to be ejected; and the like.

Figure 2:
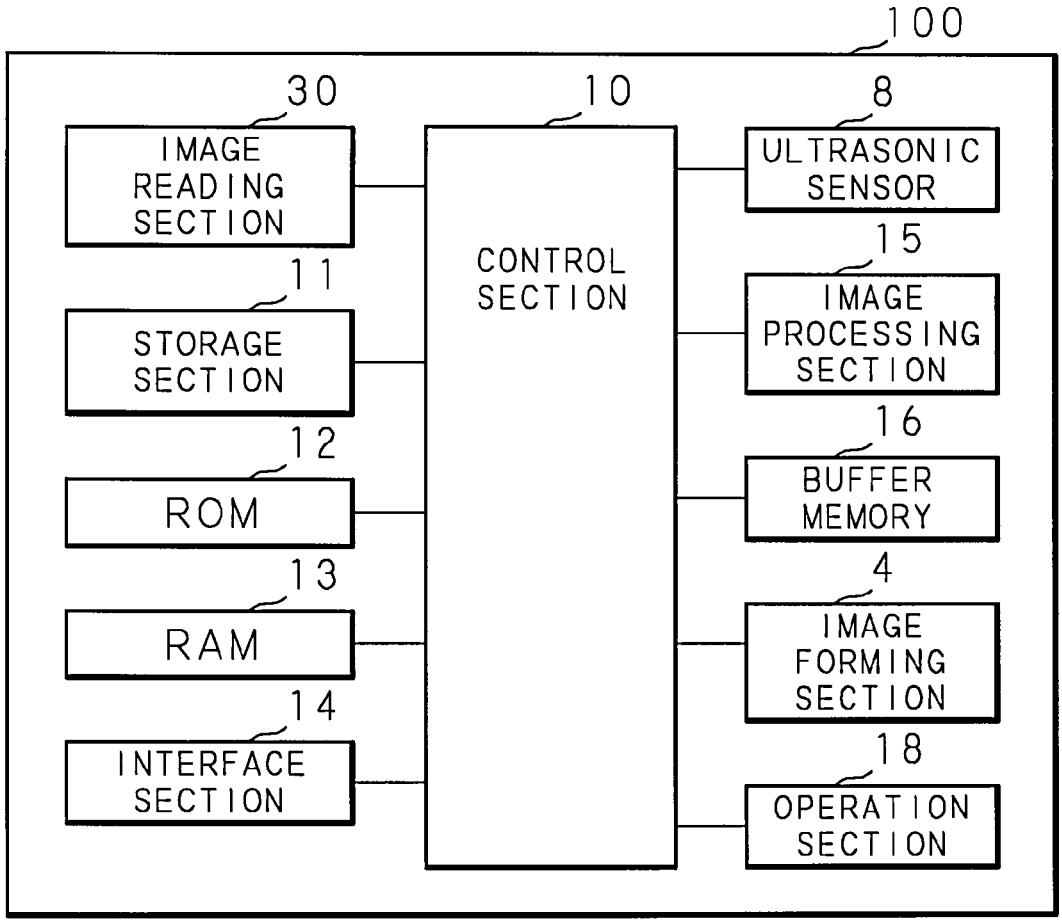
FIG. 2 is a block diagram showing the internal structure of an image forming apparatus according to the present invention.

The respective trays 51*a*, 51*b* and 51*c* are provided with recording paper sensors 54*a*, 54*b* and 54*c* for detecting the presence or absence of recording paper ejected to the trays, which sensors respectively detect the presence or absence of recording paper on the respective trays and output detection result to a control section 10 (see FIG. 2). The manual paper feeding tray 44, the recording paper holders 61, the trays 51*a*, 51*b* and 51*c*, the resist rollers 45 and the carrying roller 50 located on the paper path and the like operate as a sheet carrying unit.

FIG. 2 is a block diagram showing the internal structure of the image forming apparatus 100 according to the present invention. The image forming apparatus 100 comprises the control section 10 such as a CPU (Central Processing section) for performing various kinds of computation. The control section 10 is connected with: the image reading section 30; a storage section 11 such as an HDD (Hard Disk Drive); a ROM (Read Only Memory) 12; a RAM (Random Access Memory) 13; an interface section 14; the ultrasonic sensor 8; an image processing section 15; a buffer memory 16; the image forming section 4; an operation section 18; and the like via an internal bus, and the control section 10 controls the operation of the respective hardware sections.

The ROM 12 prestores a control program which shows the process procedure of the control section 10. The CPU of the control section 10 loads the control program stored in the ROM 12 to the RAM 13, so that the control section 10 controls the operation of the image forming apparatus 100 according to the control procedure shown by the control program. The image reading section 30 applies photoelectric conversion for reflected light from an original copy with the CCD line sensor as described above, so as to convert an obtained analog signal into a digital signal with an A/D converter. The image reading section 30 makes corrections of the orientation characteristic of the light source at the time of reading of an original copy, sensitivity unevenness of the image sensor and the like for a digital signal obtained by the conversion and stores obtained image data in the storage section 11 under the control of the control section 10.

The image processing section 15 generates data (data for image formation), which is for controlling semiconductor laser for forming an electrostatic latent image on the surface of the photoconductor drum, for each one sheet of recording paper based on the image data stored in the storage section 11 and temporarily stores the generated data in the buffer memory 16. The image processing section 15 outputs a counting signal indicating on what number sheet of recording paper the generated data is to be formed to the control section 10 every time data for image formation is generated. Accordingly, the control section 10 can determine data for image formation of what number sheet of recording paper has been already generated.

The image forming section 4 forms an image on recording paper based on the data for image formation stored in the buffer memory 16 under the control of the control section 10. Carrying of recording paper is controlled by the control section 10. The image forming section 4 outputs an output signal, which shows on what number sheet of recording paper an image has been formed, to the control section 10 every time an image is formed on recording paper. Accordingly, the control section 10 can determine on what number sheet of recording paper an image has been already formed with data for image formation which has been already generated. It should be noted that the image forming section 4 is not limited to the electrophotographic method, and may be any one of the ink jet method, the heat transfer method and the like.

The ultrasonic sensor (double feed detecting means) 8 detects double feed of recording paper at the paper path between the resist rollers 45 and the junction of paper paths from the manual paper feeding tray 44 and the multistage paper feeding section 6 and outputs detection result to the control section 10. It should be noted that double feed of recording paper means a state where two sheets of recording paper are overlapped with each other while being carried, although recording paper should be carried separately one by one in a normal situation.

Figure 3:
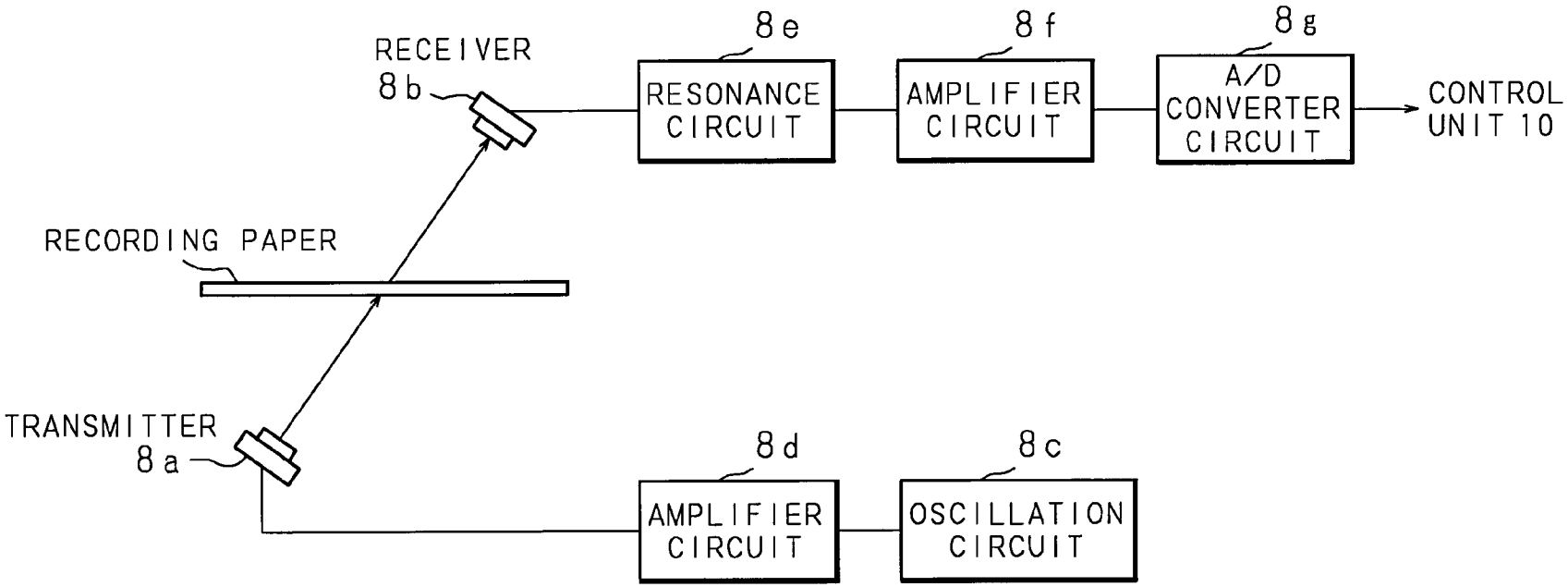
FIG. 3 is a block diagram showing the structure of an ultrasonic sensor.

FIG. 3 is a block diagram showing the structure of the ultrasonic sensor 8. The ultrasonic sensor 8 comprises, for example: an oscillation circuit 8*c* for generating a waveform driving signal having an oscillation frequency of approximately 220 kHz; an amplifier circuit 8*d* for amplifying the waveform driving signal generated by the oscillation circuit 8*c*; the transmitter 8*a* for transmitting a waveform driving signal; the receiver 8*b* for receiving the signal transmitted by the transmitter 8*a*; a resonance circuit 8*e* for detecting the signal received by the receiver 8*b* in a wide band (e.g., 220 kHz±20 kHz); an amplifier circuit 8*f* for amplifying the received signal; an A/D converter circuit 8*g* for converting the amplified signal into a digital signal; and the like.

The ultrasonic sensor 8 transmits a signal from the transmitter 8*a* for recording paper to be carried and outputs a detection signal, which is obtained by receiving the transmitted signal by the receiver 8*b*, to the control section 10, so as to detect the number of sheets of recording paper to be carried, i.e. double feed, based on the amount of energy of the signal. As the ultrasonic sensor 8, the MA200D1-1 manufactured by Murata Manufacturing Co., Ltd. can be used, for example. It should be noted that the means for detecting double feed is not limited to an ultrasonic sensor and other sensors can be also used.

The control section 10 drives a pickup roller, which is not illustrated, in a controlled manner so as to feed recording paper from the manual paper feeding tray 44 or a recording paper holder 61 to the paper path and drives rollers on the paper path, such as the resist rollers 45 and the carrying roller 50, in a controlled manner so as to carry the recording paper. The control section 10 also controls a guide driving section, which is not illustrated, so as to switch the guides 52 and 53. For example, for performing a required printing process, the guides 52 and 53 are switched to eject recording paper having an image formed thereon to the first tray 51*a*.

The operation section 18 is an operator control panel of a touch panel type and comprises: various kinds of keys and switches for accepting an operation instruction by the user; and a liquid crystal display for displaying information to be annunciated to the user. The operation section 18 displays, for example, an error message or the like when double feed is detected. The operation section (accepting means) 18 also accepts a type of recording paper to be carried.

The interface section 14 obtains image data from an information processor such as an external personal computer and stores the obtained image data in the storage section 11.

Figure 4:
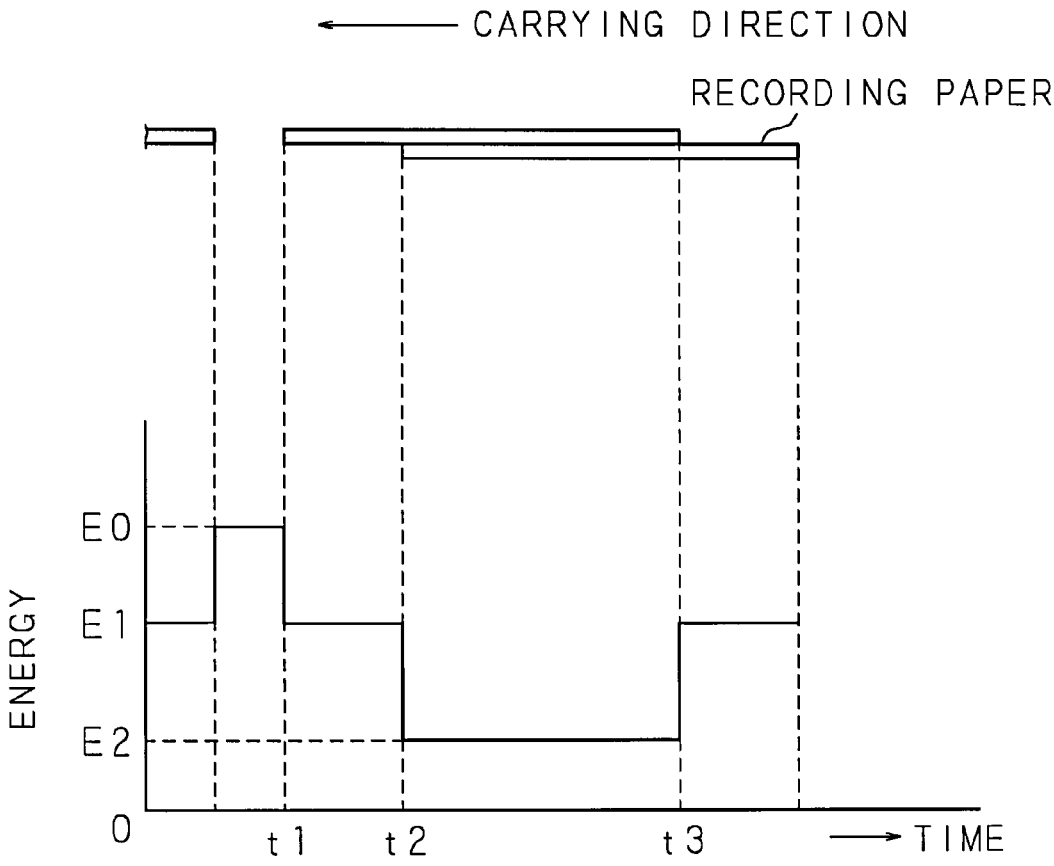
FIG. 4 is a view showing an example of double feed of recording paper.

FIG. 4 is a view showing an example of double feed of recording paper, and shown in the example of the figure is a timing diagram of an output level of a double feed detection signal when end portions of two sheets of recording paper go out of alignment. The energy (e.g., transmission energy) of a signal received by the receiver 8*b* of the ultrasonic sensor 8 changes depending on the number of sheets of recording paper through which the signal transmits. For example, the energy of a received signal is E0 when there is no recording paper, the energy of a received signal is E1 (E0>E1) when there is one sheet of recording paper and the energy of a received signal is E2 (E1>E2) when two sheets of recording paper are overlapped with each other.

At a time t1 when the energy of a signal changes from E0 to E1, it is detected that the next recording paper has been carried. When double feed of recording paper takes place, the energy of a signal at a time t2 changes from E1 to E2 and the energy of a signal at a time t3 changes from E2 to E1, for example. The level difference (E1−E2) of the energy of a received signal makes it possible to detect that two sheets of recording paper is fed in a duplicated manner with the end portions thereof being out of alignment. It is also possible to calculate for how long recording paper is out of alignment in double feed based on the carrying speed of recording paper and the time difference between the time t2 and the time t1.

The control section 10 determines the presence or absence of double feed based on detection result (level of detection signal) outputted from the ultrasonic sensor 8. The control section (stopping means) 10 stops sheet carrying once and terminates the printing process based on the type of recording paper (sheet) accepted by the operation section 18 (accepting means) and the detection result of the ultrasonic sensor 8, and then ejects the recording paper. In particular, the control section 10 stops carrying of recording paper in response to detection of double feed when the type of recording paper accepted by the operation section 18 is not a predetermined type, or does not stop carrying of recording paper even though double feed is detected when the type of recording paper accepted by the operation section 18 is a predetermined type. The predetermined type of recording paper is recording paper having air space inside thereof, such as an envelope, an OHP sheet made by appending and attaching a protective sheet, Kent paper made by pasting two sheets together or WASHI having air space distributed therein.

Figure 5:
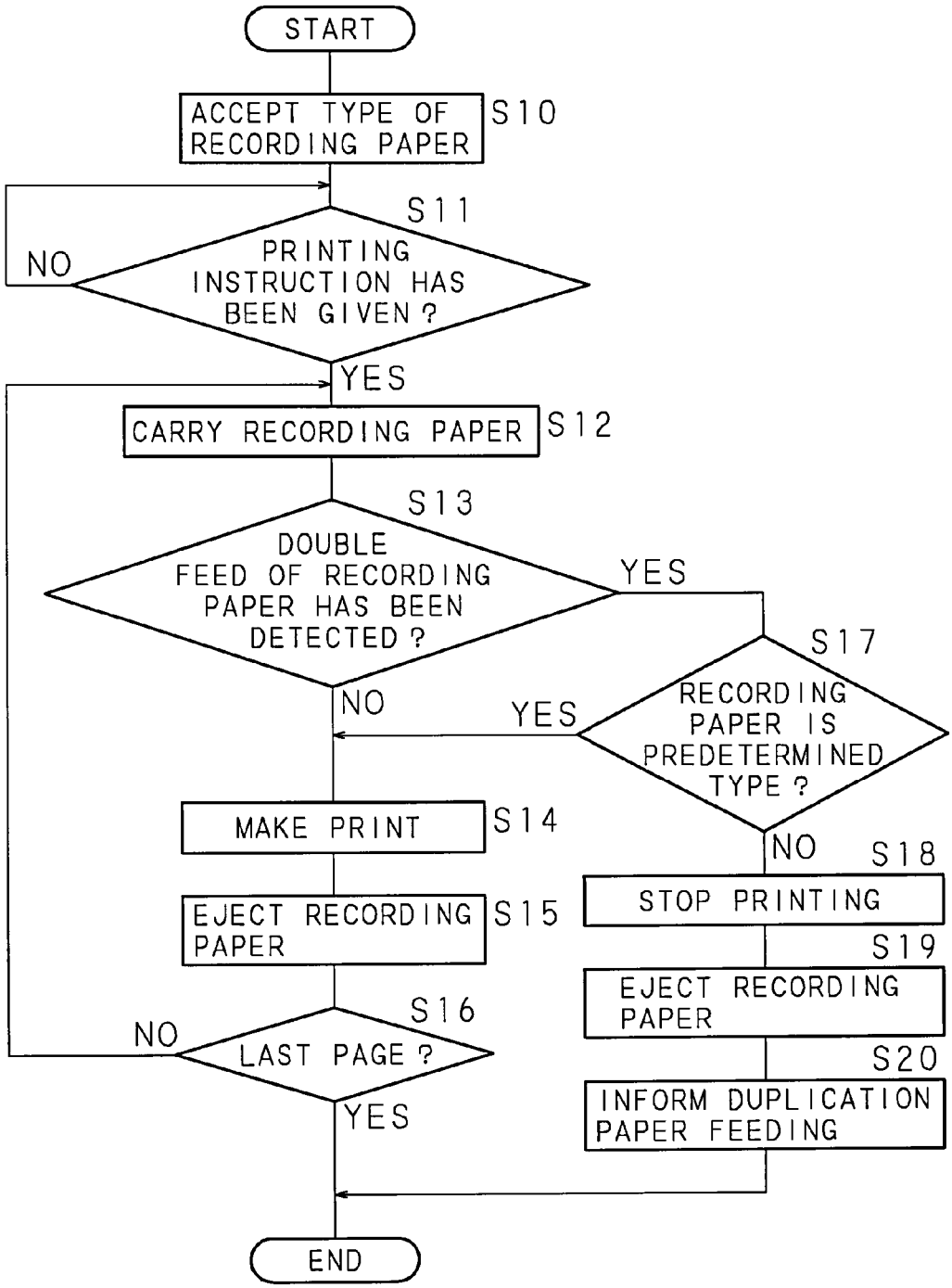
FIG. 5 is a flow chart showing the procedure of an image forming process on recording paper.

FIG. 5 is a flow chart showing the procedure of an image forming process on recording paper. The control section 10 accepts a type of recording paper from the operation section 18 (S10) and then determines whether a printing instruction using a Start key or the like has been made or not (S11). When a printing instruction has not been made (S11: NO), the control section 10 waits for a printing instruction.

When a printing instruction has been made (S11: YES), the control section 10 drives rollers placed on the paper path and the like to carry recording paper (S12). The control section 10 determines whether double feed of recording paper has been detected based on a signal of the ultrasonic sensor 8 or not (S13). When double feed of recording paper has not been detected (S13: NO), the control section 10 controls the image forming section 4 for making prints on recording paper (S14) and ejects the recording paper having an image printed thereon to a tray (e.g., the first tray 51*a*) (S15).

The control section 10 determines whether the page is the last page or not (S16), and continues the process starting from the step S12 when the page is not the last page (S16: NO). When the page is the last page (S16: YES), the control section 10 terminates the image forming process.

On the other hand, when double feed is detected (S13: YES) and recording paper is of the predetermined type (envelope, OHP sheet or Kent paper) (S17: YES), the control section 10 controls the image forming section 4 to make prints on recording paper (S14) and executes the same process after that. When recording paper is not of a predetermined type (S17: NO), the control section 10 stops carrying of recording paper once, terminates printing (S18) and executes a print stopping process and, at the same time, ejects recording paper (S19) and makes error display on the operation section 18 to inform that double feed has taken place (S20).

As described above, when the recording paper is of a predetermined type (envelope, OHP sheet, Kent paper or WASHI) having air space inside thereof, a printing process is not stopped even though double feed is detected, so that a printing process can be executed.

Although the above embodiment is constructed not to stop a printing process even though double feed is detected when recording paper is of a predetermined type (envelope, OHP sheet, Kent paper or WASHI), detection of double feed can be stopped when recording paper is of a predetermined type. Moreover, the sheet having air space inside thereof is not limited to an envelope, an OHP sheet, Kent paper or WASHI.

Although the above each embodiment is constructed to use an ultrasonic sensor as the means for detecting double feed of recording paper, the present invention is not limited to this and may be constructed to use an optical sensor, for example. However, an ultrasonic sensor is better in terms of detection accuracy since, when an optical sensor is used to detect the length of recording paper in carrying direction so as to detect double feed if a distance between the front end and the back end of the recording paper is larger than the dimension of the original copy, the apparatus may possibly be unable to detect double feed if two sheets of recording paper are overlapped completely.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A sheet carrying control method comprising the steps of:
accepting a type of a sheet to be carried;
detecting double feed of sheets;
determining whether the type of the sheet to be carried is a predetermined type or not when double feed of sheets is detected;
executing carrying a sheet when double feed of sheets is not detected or when the type of the sheet to be carried is the predetermined type; and
stopping carrying a sheet when the type of the sheet to be carried is not the predetermined type.

2. The sheet carrying control method according to claim 1, wherein carrying of a sheet is stopped in response to detection of double feed when the accepted type of a sheet is not a sheet having air space inside thereof.

3. A sheet carrying unit comprising:
a sheet carrying section for carrying a sheet;
an accepting section for accepting a type of a sheet to be carried;
a double feed detecting section for detecting double feed of sheets; and
a controller adapted to:
determine whether double feed of sheets is detected or not by the double feed detecting section;
determine whether the type of the sheet to be carried is a predetermined type or not when double feed of sheets is detected;
execute carrying a sheet when double feed of sheets is not detected or when the type of the sheet to be carried is the predetermined type; and
stop carrying a sheet when the type of the sheet to be carried is not the predetermined type.

4. The sheet carrying unit according to claim 1, wherein the predetermined type of sheet is a sheet having air space inside thereof.

5. An image forming apparatus comprising:
a sheet carrying unit according to claim 4; and
an image forming section for forming an image on a sheet carried by the sheet carrying unit.

6. The sheet carrying unit according to claim 1, wherein the predetermined type of a sheet is any one of an envelope, an OHP sheet and Kent paper.

7. The sheet carrying unit according to claim 6, further comprising a manual paper feeding tray, wherein the sheet carrying section carries a sheet placed in the manual paper feeding tray.

8. An image forming apparatus comprising:
a sheet carrying unit according to claim 7; and
an image forming section for forming an image on a sheet carried by the sheet carrying unit.

9. An image forming apparatus comprising:
a sheet carrying unit according to claim 6; and
an image forming section for forming an image on a sheet carried by the sheet carrying unit.

10. An image forming apparatus comprising:
a sheet carrying unit according to claim 1; and
an image forming section for forming an image on a sheet carried by the sheet carrying unit.

11. A sheet carrying unit comprising:
sheet carrying means for carrying a sheet;
accepting means for accepting a type of a sheet to be carried;
double feed detecting means for detecting double feed of sheets; and
means for:
determining whether double feed of sheets is detected or not by the double feed detecting section;
determining whether the type of the sheet to be carried is a predetermined type or not when double feed of sheets is detected;
executing carrying a sheet when double feed of sheets is not detected or when the type of the sheet to be carried is the predetermined type; and
stopping carrying a sheet when the type of the sheet to be carried is not the predetermined type.

12. The sheet carrying unit according to claim 11, wherein the predetermined type of sheet is a sheet having air space inside thereof.

13. The sheet carrying unit according to claim 12, wherein the predetermined type of sheet is any one of an envelope, an OHP sheet and Kent paper.

14. The sheet carrying unit according to claim 13, further comprising a manual paper feeding tray,
wherein the sheet carrying means carries a sheet placed in the manual paper feeding tray.

15. An image forming apparatus comprising:
a sheet carrying unit according to claim 11; and
image forming means for forming an image on a sheet carried by the sheet carrying unit.

* * * * *